United States Patent [19]

Ohtake et al.

[11] Patent Number: 4,536,226

[45] Date of Patent: Aug. 20, 1985

[54] METHOD OF MANUFACTURING A SHADOW MASK FOR A COLOR CATHODE RAY TUBE

[75] Inventors: Yasuhisa Ohtake; Hiroshi Tanaka; Koichiro Oka, all of Saitama, Japan

[73] Assignee: Kabushiki Kaisha Toshiba, Kawasaki, Japan

[21] Appl. No.: 603,867

[22] Filed: Apr. 25, 1984

[30] Foreign Application Priority Data

Apr. 27, 1983 [JP] Japan ..... 58-72935

[51] Int. Cl.[3] ..... C21D 8/04; C22C 38/08

[52] U.S. Cl. ..... 148/12 C; 148/12.1; 148/36; 313/402

[58] Field of Search ..... 148/12 R, 12 C, 12.1, 148/36, 409, 426; 75/123 K; 420/459; 313/402; 445/47

[56] References Cited

U.S. PATENT DOCUMENTS 3,909,311 9/1975 Yamada et al. ..... 148/12.1

3,909,928 10/1975 Sato et al. ..... 313/402

FOREIGN PATENT DOCUMENTS 2350366 4/1975 Fed. Rep. of Germany ..... 313/402

OTHER PUBLICATIONS

Flor et al., "Plastic Deformation of Fe-Ni Invar Alloys", Acta Metallurgica, vol. 28, 1980, pp. 1611-1619.

Dieter, Jr., *Mechanical Metallurgy,* McGraw-Hill Book Co., New York, 1961, pp. 99-101.

*Primary Examiner*—Peter K. Skiff

*Attorney, Agent, or Firm*—Banner, Birch, McKie & Beckett

[57] ABSTRACT

A method of manufacturing a shadow mask includes the steps of perforating a number of apertures in a sheet of iron-nickel alloy, annealing the sheet, and forming the sheet, after annealing, into a shadow mask by pressing while the sheet is kept at a predetermined forming temperature effective to reduce the yield strength of the alloy.

11 Claims, 9 Drawing Figures

METHOD OF MANUFACTURING A SHADOW MASK FOR A COLOR CATHODE RAY TUBE

BACKGROUND OF THE INVENTION

This invention relates to a method of manufacturing a a color cathode ray tube shadow mask from an iron-nickel alloy.

In a conventional color cathode ray tube (CRT) as shown in FIG. 1, three electron beams 1, 2, and 3 from separate electron guns (not shown) are correctly radiated onto red, green and blue phosphors 7, 8, and 9 coated on the inner surface of a panel 6. The beams strike the phosphors after passing through apertures 5 perforated in a shadow mask 4. The phosphors 7, 8, and 9 then emit red, green and blue light to form a color image.

A shadow mask in a color CRT of this type must satisfy certain specific requirements. Small apertures must be correctly formed in a regular pattern. The shadow mask must be curved with a predetermined radius of curvature. The distance (to be referred to as the q value hereinafter) between the shadow mask and the inner surface of the panel must be maintained at a predetermined value.

When the color CRT is operated, the beam current passing through the apertures in the shadow mask comprises about one-third or less of the total beam current originally emitted by the electron guns. The remaining electrons bombard the shadow mask, which is, in some cases, heated to a temperature of 353 K. As a result, the shadow mask thermally expands to have a q value different from the predetermined q value, thus causing the "dome phenomenon." When the dome phenomenon occurs, the color purity of the CRT is degraded. The material conventionally used for a shadow mask, and which contains nearly 100% iron, such as aluminum-killed decarbonized steel, has a coefficient of thermal expansion of about $12\times10^{-6}$/K at 273 K. to 373 K. This material is thus easily vulnerable to the dome phenomenon.

In view of this problem, Japanese Patent Publication No. 42-25446, Japanese Patent Disclosure No. 50-58977 and Japanese Patent Disclosure No. 50-68650 propose the use of an iron-nickel alloy, which has a small thermal expansion coefficient, as the material of a shadow mask. However, this proposal has not yet led to practical use of such a material in a shadow mask. One of the reasons preventing the practical use of such a material is the difficulty of working a metal sheet consisting of an iron-nickel alloy. In order that the q value fall within a predetermined allowable range, the curved surface of the shadow mask should be controlled with high precision. For example, the allowable error for a radius of curvature R of 1,000 mm is as small as ±5 mm.

An iron-nickel alloy has an extremely high elasticity and a high tensile strength after annealing, as compared to ordinary iron. Accordingly, the iron-nickel alloy tends to a greater degree to return to its orignal shape when one attempts to deform it into a curved surface by pressing it in a mold. When a 200-um-thick sheet of any material is pressed into a shadow mask in the mold of FIG. 8, the resulting mask is considered acceptable if its maximum deformation d from the designed surface at a predetermined position on the shadow mask is 20 um or less after the mask is removed from the mold. Deformation d is illustrated in FIG. 2, an exaggerated view.

FIG. 3 shows the measured relationship between deformation d and yield strength for a 14 inch shadow mask. Yield strength is the tension at which the length of the material increases by 0.2%, sometimes called "0.2% proof strength." From this curve it can be seen that in order to maintain the deviation at or below 20 um, yield strength must not be greater than $19.6\times10^{7}$N/m$^2$. (Since iron-nickel alloys do not clearly show the yielding phenomenon, throughout the specification tensile strength is substituted for 0.2% proof strength for these alloys.)

FIG. 4 compares the yield strength of conventional aluminum-killed decarbonized steel, curve (a), with that of an iron-nickel alloy, curve (b), for various annealing temperatures. Both curves are for shadow masks annealed in hydrogen in an annealing furnace generally used for the conventional aluminum-killed decarbonized steel shadow mask. As can be seen from FIG. 4, even if the iron-nickel shadow mask is annealed at the relatively high temperature of 1173 K., the yield strength still drops to only about $28.4\times10^{7}-29.4\times10^{7}$N/m$^2$.

As explained above, since shadow masks made of an iron-nickel alloy have a small thermal expansion coefficient, their use substantially eliminates degradation in color purity due to thermal deformation of the mask. However, degradation in color purity due to inability to form the mask to the proper shape (d less than or equal to 20 um) still remains.

SUMMARY OF THE INVENTION

It is an object of the invention to provide a method of manufacturing a shadow mask from an iron-nickel alloy.

It is a another object of the invention to provide such a method in which the deviation d is less than or equal to 20 um.

It is a another object of the invention to provide such a method in which the color purity of the color CRT is not degraded.

The aforementioned objects are attained in accordance with the invention by annealing a sheet of an iron-nickel alloy and then forming it into a shadow mask by pressing, while keeping the sheet at a predetermined forming temperature effective to reduce the yield strength of the sheet.

BRIEF DESCRIPTION OF THE DRAWINGS

FIG. 4(*b*) is a graph of yield strength versus annealing temperature in hydrogen for a shadow mask of an iron-nickel alloy.

DETAILED DESCRIPTION OF THE PREFERRED EMBODIMENT

Figure 1:
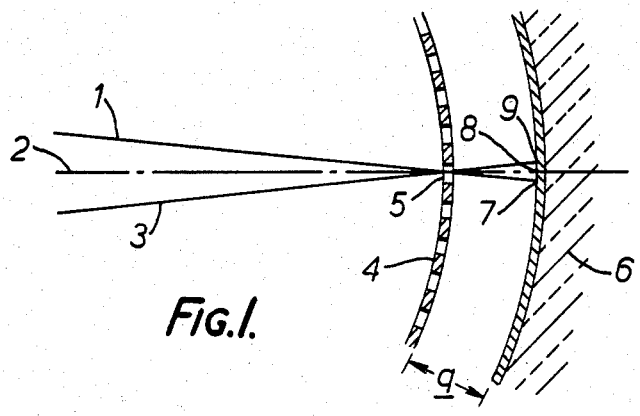
FIG. 1 is an enlarged sectional diagram of a portion of a color CRT.
Figure 2:
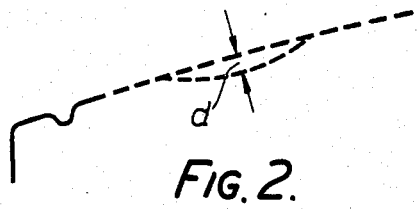
FIG. 2 is a schematic representation illustrating the deformation d between the actual curvature of a shadow mask and the ideal curvature.
Figure 3:
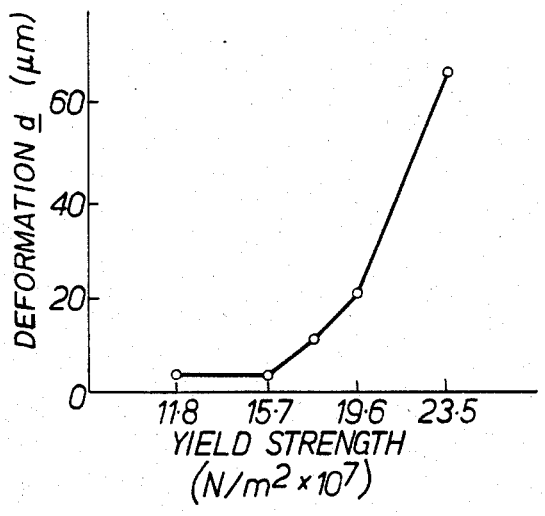
FIG. 3 is a graph of the relationship between d and yield strength.
Figure 4:
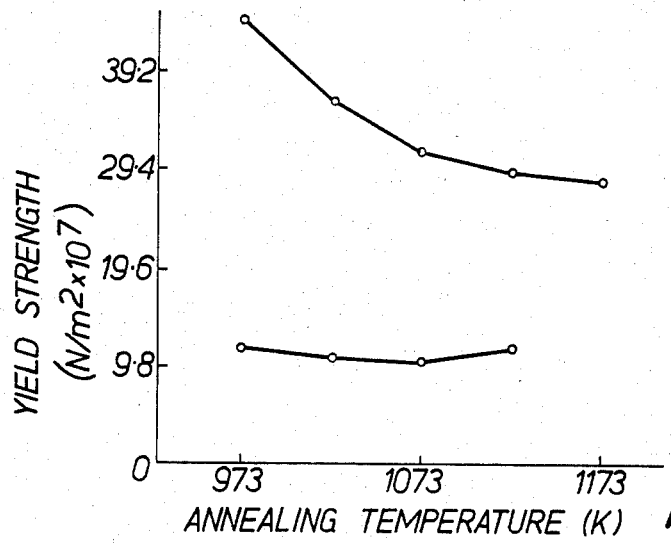
FIG. 4(*a*) is a graph of yield strength versus annealing temperature in hydrogen for a conventional shadow mask of aluminum-killed decarbonized steel.

The present invention will be explained with reference to an embodiment wherein an iron-nickel alloy, such as Invar, is used as the material for a shadow mask.[1] Since the structure of a color CRT of the present invention is basically the same as that shown in FIG. 1, a detailed description will be omitted.

[1]Invar is a trademark with registration number 63,970.

Table 1 compares the compositions of an Invar alloy used in the present invention with a conventional aluminum-killed decarbonized steel.

TABLE 1

| Type/ Composition | Composition of shadow mask material (wt %) | | | | | | | |
|---|---|---|---|---|---|---|---|---|
| | C | Mn | Si | P | S | Al | Ni (+Co) | Fe |
| Invar | 0.009 | 0.4 | 0.13 | 0.00 | 0.002 | — | 36.5 | 62+ |
| aluminum-killed decarbonized steel | 0.002 | 0.30 | 0.01 | 0.016 | 0.009 | 0.052 | — | 99+ |

Figure 5:
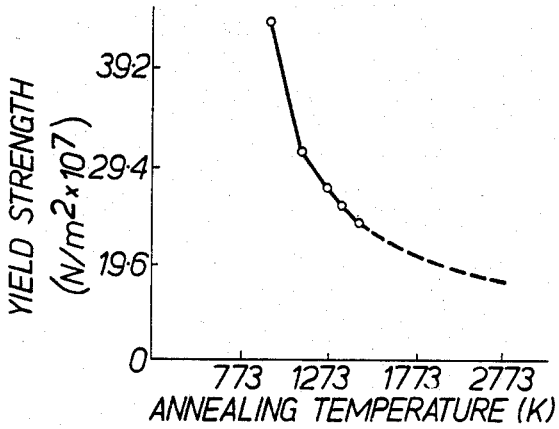
FIG. 5 is another graph of the relationship between yield strength and annealing temperature in hydrogen for an iron-nickel alloy, the graph of FIG. 5 showing the relationship over a greater temperature range than the graph of FIG. 4(*b*).

Concerning the 36% Ni Invar shadow mask with the above composition, FIG. 5 shows the yield strength as a function of the annealing temperature in which the annealing was done in an annealing furnace having a conventional hydrogen atmosphere. As shown in FIG. 5, even if the sheet is annealed at a temperature as high as 1473 K., the yield strength is reduced to only $23.5\times10^7 N/m^2$. Accordingly, in order to suppress the yield point strength to $19.6\times10^7 N/m^2$ or less, which is necessary to give good curved surface formation, extrapolation of the results shown in FIG. 5 (along the dashed line) reveals that the annealing temperature must fall within the range of 1773 to 1973 K. However, since the Invar alloy has a melting point of 1713 to 1728 K., simple heating to a temperature within the above-mentioned range cannot be performed.

As the result of our observation of the annealed shadow mask sheet, we discerned that in accordance with increasing the annealing temperature the crystal grains in the interior of the sheet grow well, but the crystal grains at the surface of the sheet grow very little. The retarded crystal grain growth at the surface of the sheet is associated with the yield strength. The difference between the crystal grain growth within and at the surfaces of the sheet is considered to be attributable to slight segregation of impurities in the direction of thickness of the sheet, particularly at the grain boundaries in the vicinity of the surface of the sheet. Therefore, the sheet was annealed in a vacuum in order to be able to facilitate the crystal grain growth by vaporizing the manganese (Mn), phosphorus (P), sulfur (S), and so on, having a high vapor pressure, from the grain boundaries, without greatly affecting the oxides of these impurities at the surface layer of the sheet. The sheet is annealed for ten minutes at a temperature of 1173 to 1473 K. at a pressure of 133 mPa. As understood from Table 2 showing the composition of a surface layer whose thickness is 1/20 or less of that of the sheet, the percentages of impurities, such as manganese, phosphorus, sulfur and so on are greatly decreased.

TABLE 2

| | Composition (wt %) before and after annealing in vacuum | | | | | | |
|---|---|---|---|---|---|---|---|
| | C | Mn | Si | P | S | Ni(+Co) | Fe |
| Before Annealing | 0.009 | 0.4 | 0.13 | 0.005 | 0.002 | 36.5 | 63− |
| After Annealing | 0.007 | 0.052 | 0.12 | 0.001 | 0.001 | 36.3 | 63+ |

Figure 6:
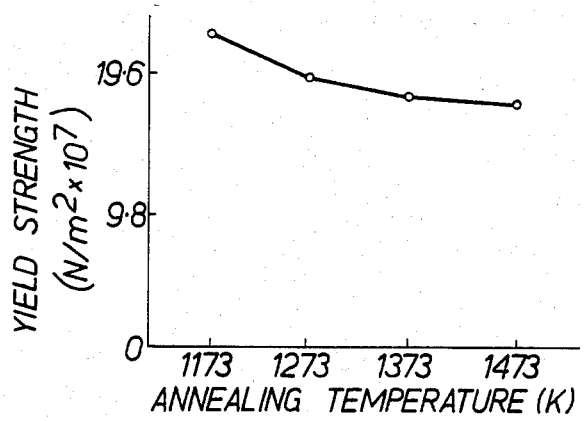
FIG. 6 is a graph of the relationship between yield strength and annealing temperature in vacuum of an iron-nickel alloy.

As shown in FIG. 6, a shadow mask with a yield strength of $19.6\times10^7 N/m^2$ or less may be obtained by annealing at a temperature of more than 1273 K. However, from a viewpoint of mass production of color CRT's, it would be preferable to achieve this low yield strength at a much lower annealing temperature.

Figure 7:
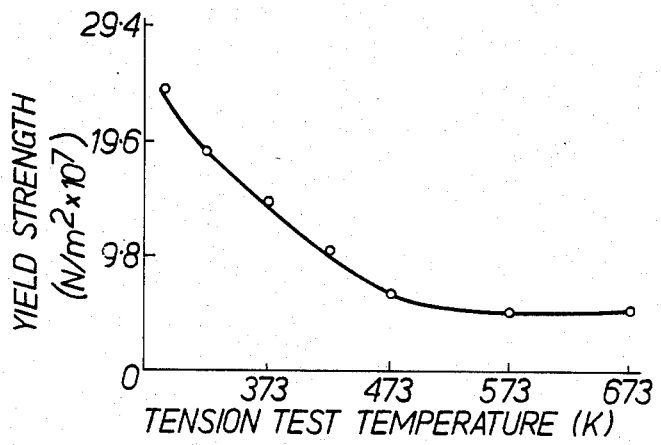
FIG. 7 is a graph of the relationship between yield strength of an iron-nickel alloy and temperature under tension. The iron-nickel test pieces used for plotting FIG. 7 were all annealed in vacuum for ten minutes at a temperature of 1273 K.

As temperature affects the yield strength of metals, we investigated the relationship between the temperature during forming and the yield strength of Invar. First, in order to measure the yield strength of the Invar by a tension test, Invar test pieces were annealed at a pressure of 13.3 Pa for ten minutes at a temperature of 1273 K. Then the yield strength of the samples was measured at various temperatures from 298 K. to 673 K. in an electric furnace using the tension test. The results are shown in FIG. 7.

As the result of our investigation, we discovered that the yield strength of Invar suddenly decreases from a temperature of 298 K. with increasing temperature of the shadow mask sheet. And the phenomenon of decrease in the yield strength is saturated at a temperature of about 473 K. The result of our investigation means that even if a shadow mask sheet made of an iron-nickel alloy has an excessive yield strength after annealing affecting its ability to be formed in a press, the forming of the sheet is easily performed by heating during pressing in order to decrease the yield strength.

Figure 8:
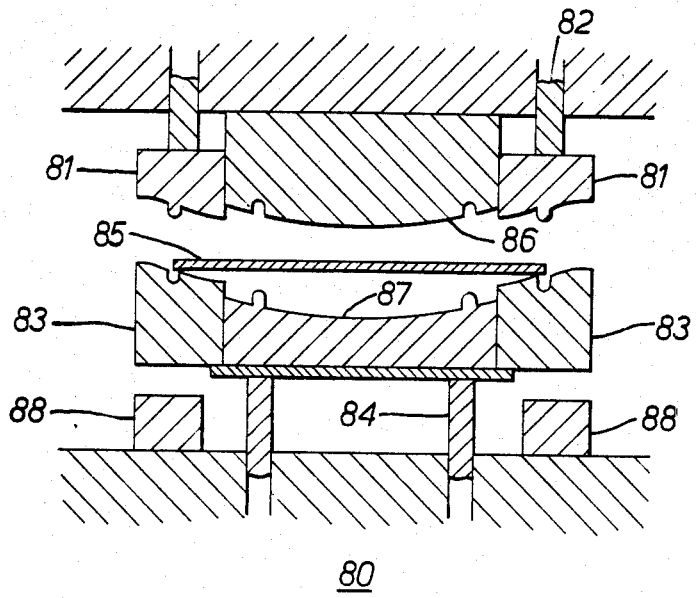
FIG. 8 is a sectional elevation of the press mold used for forming shadow masks in accordance with the invention.

Based on the above results, shadow mask sheets were formed at various temperatures in order to investigate the formability of the sheets. During the forming of the sheet, the mold was heated to the temperature of the sheet and, further, the temperature was maintained by a heater, such as an infrared lamp, external to the mold (because the temperature of the sheet is decreased by the mold if the temperature of the mold is lower than that of the sheet). The press mold 80 as shown in FIG. 8 comprises a blank holder 81 connected to upper piston 82 and a die 83 supported by lower piston 84 in order to releasably hold the periphery of the shadow mask sheet 85 therebetween. Press mold 80 further comprises punch 86 and knockout 87 in order to form the sheet 85 into a curved mask therebetween. The blank holder 81 and the die 83 are slidably mounted on punch 86 and knockout 87, respectively. A spacer 88 is also provided in order to adjust the height of the die 83 when the punch 86 goes down. Therefore, in order to heat the press mold 80, a heater may be provided in the punch 86 and knockout 87, or a heating material, such as heated oil, may be circulated in a path provided in the punch 86 and knockout 87. At the starting of the press, the shadow mask sheet to be pressed is heated to a predetermined forming temperature by dipping the sheet into lubricating oil at the predetermined temperature.

Figure 9:
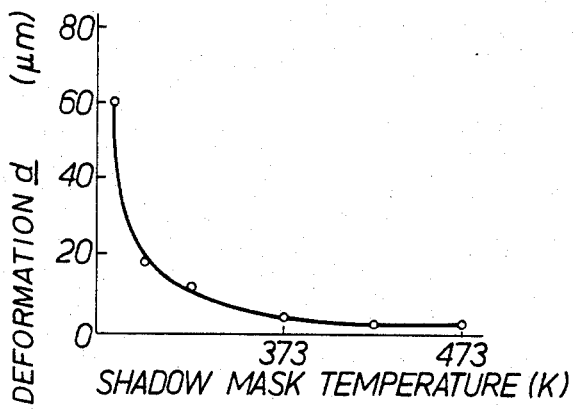
FIG. 9 is a graph of the relationship between deformation d of shadow masks formed in the mold of FIG. 8 and shadow mask temperature, the temperature of the shadow mask being detected by measuring the temperature of the mold.

In order to evaluate the formability of this invention, the above-mentioned deformation d to the radius (R) of the shadow mask is measured by a three-dimensional measuring instrument. The result of the measurement is shown in FIG. 9. As shown in FIG. 9, the deformation characteristics as a function of press temperature is analogous to the yield strength characteristics shown in FIG. 7. The deviation at a pressing temperature of 373 K. is about 4 um, and the deviation is saturated at pressing temperatures above 373 K. This amount of deformation means that no problem occurs in curved surface formability.

The pressing temperature may be increased up to a recrystallization temperature of about 973 K. However, since the higher the pressing temperature, the larger the size of the equipment required, it is better to press at the lowest pressing temperature consistent with required formability. For example, if vacuum annealing is used, the pressing temperature must be at least 298 K. in order to realize a deformation of less than 20 um, but any pressing temperatures less than or equal to 373 K. are desirable because of mass production equipment. If annealing in hydrogen is used, as the yield strength of material annealed in hydrogen is higher than that of material anealed in vacuum, the pressing temperature must be correspondingly higher. In this case, the pressing temperature may be less than or equal to 473 K. because of the size of manufacturing equipment. There is no difference of spherical quality of the shadow mask between the above two annealings for the heating press. These annealings can be performed before perforating the apertures.

A color CRT shadow mask prepared in this manner has a thermal expansion coefficient which is as small as $1\times10^{-6}$/K to $2\times10^{-6}$/K at temperatures within the range of 273 K. to 373 K. Accordingly, such a color CRT will not suffer from the problem of degradation in color purity due to thermal expansion of the shadow mask and due to mechanical deformation of the shadow mask.

The material of the sheet for a shadow mask according to the present invention is not limited to a 36% Ni Invar alloy. Similar effects may be obtained with iron-nickel alloys containing as much as 42% Ni, or with a 32% Ni-5% Co super Invar, and the like.

Although illustrative embodiments of the invention have been described in detail with reference to the accompanying drawings, it is to be understood that the invention is not limited to those precise embodiments and that various changes and modifications may be effected therein by one skilled in the art without departing from the scope or spirit of the invention.

We claim:

1. A method of manufacturing a shadow mask from a sheet having a polycrystalline structure of an alloy comprising iron and nickel, the sheet having a yield strength, said method comprising the steps of:

perforating the sheet;

annealing the perforated sheet at a first predetermined temperature effective to reduce the yield strength, the first predetermined temperature being between a recrystallization temperature and a melting temperature of the alloy; and pressing the annealed sheet while maintaining the sheet at a second predetermined temperature effective to further reduce the yield strength, the second predetermined temperature being lower than the first predetermined temperature and being maintained during at least part of said step of pressing.

2. The method of claim 1 wherein the alloy is Invar.

3. The method of claim 1 wherein the fraction of nickel comprising the alloy is between about 0.32 and about 0.42 by weight.

4. The method of claim 1 wherein the second predetermined temperature is lower than the recrystallization temperature.

5. The method of claim 1 wherein the second predetermined temperature is less than about 473 K.

6. The method of claim 1 wherein said step of annealing comprises annealing the sheet at a pressure no greater than about 13.3 Pa.

7. The method of claim 6 wherein the first predetermined temperature is between about 1173 K. and about 1473 K.

8. The method of claim 1 wherein said step of annealing comprises annealing the sheet in an atmosphere comprising hydrogen.

9. The method of claim 1 wherein the second predetermined temperature is not less than about 298 K.

10. The method of claim 1 wherein the second predetermined temperature is effective to reduce the yield strength of the sheet to no more than about $19.6\times10^{7}$N/m$^2$.

11. A shadow mask manufactured by the method of claim 1.

* * * * *